US006121557A

United States Patent [19]

Warringa

[11] Patent Number: 6,121,557

[45] Date of Patent: Sep. 19, 2000

[54] POLE REVERSER SWITCH WITH MOULDED CONTACTS

[75] Inventor: Koop L. L. Warringa, Eindhoven, Netherlands

[73] Assignee: Capax B.V., Eindhoven, Netherlands

[21] Appl. No.: 09/250,306

[22] Filed: Feb. 16, 1999

[30] Foreign Application Priority Data

Feb. 17, 1998 [NL] Netherlands ..... 1008325

[51] Int. Cl.[7] ..... H01H 1/00; H01H 9/00; H01H 19/38

[52] U.S. Cl. ..... 200/1 V; 200/11 J; 200/16 C; 200/284

[58] Field of Search ..... 200/1 R, 1 V, 200/5 R, 8 R, 8 A, 11 J, 11 D, 11 DA, 316, 284, 16 R–16 D

[56] References Cited

U.S. PATENT DOCUMENTS

| | | | |
|---|---|---|---|
| 3,219,785 | 11/1965 | Allison | 200/11 D X |
| 3,525,825 | 8/1970 | Allison | 200/11 D |
| 3,525,827 | 8/1970 | Allison | 200/11 D |
| 3,548,123 | 12/1970 | Allison | 200/11 D |
| 3,564,181 | 2/1971 | Chirota et al. | 200/1 V |
| 3,571,535 | 3/1971 | Beaver et al. | 200/11 D |
| 3,668,338 | 6/1972 | O'Malley | 200/11 DA |
| 3,736,390 | 5/1973 | Lockard | 200/11 DA |
| 3,803,370 | 4/1974 | Garcia | 200/11 J |
| 4,019,000 | 4/1977 | Robinson | 200/11 D |
| 4,029,914 | 6/1977 | Schmidt et al. | 200/1 R |
| 4,894,492 | 1/1990 | Palumbo | 200/1 V |
| 5,023,414 | 6/1991 | Mihara et al. | 200/11 J |
| 5,349,143 | 9/1994 | Houser | 200/1 V X |
| 5,359,165 | 10/1994 | Leveque et al. | 200/316 X |

*Primary Examiner*—J. R. Scott
*Attorney, Agent, or Firm*—Banner & Witcoff, Ltd.

[57] ABSTRACT

The invention relates to a switch comprising a carrier which is manufactured substantially from plastic and in which fixed contacts are arranged, and a part which is movable relative to the carrier and in which movable contacts are arranged, wherein the fixed contacts are enclosed by plastic on at least a part of all their sides, so that the fixed contacts are fixed in plastic. According to a first preferred embodiment at least one plastic element extends at least on a first side of the fixed contacts, which plastic element leaves clear a part of the surface on the first side of the fixed contacts. Sufficient fixation is herein obtained by the plastic element, while it will be apparent that a contact face of the contacts must remain free in order to be able to function as a contact.

24 Claims, 4 Drawing Sheets

POLE REVERSER SWITCH WITH MOULDED CONTACTS

BACKGROUND OF THE INVENTION

The present invention relates to a switch comprising a carrier which is manufactured substantially from plastic and in which fixed contacts are arranged, and a part which is movable relative to the carrier and in which movable contacts are arranged.

Such switches are generally known. In the case of these switches the carrier made of plastic is manufactured initially, whereafter the contacts are pushed into the positions arranged for this purpose and fixed therein.

This is a time-consuming operation which must be carried out by people or which could be performed by means of costly equipment, at least if the construction of the switch were suitable therefor.

These various factors mean that the cost price of such a switch is high.

BRIEF SUMMARY OF THE INVENTION

The object of the present invention is to provide such a switch which can be manufactured at a lower cost price.

This object is achieved in that the fixed contacts are enclosed by plastic on at least a part of all their sides, so that the fixed contacts are fixed in the plastic.

This structural measure provides the option of manufacturing the contacts directly during the process of forming the housing, i.e. during the injection moulding. It will be apparent that this is a considerable labour-saving measure because no fixing operations for fixation of the contacts need be carried out.

According to a first preferred embodiment at least one plastic element extends at least one a first side of the fixed contacts, which plastic element leaves clear a part of the surface on the first side of the fixed contacts. Sufficient fixation is herein obtained by the plastic element, while it will be apparent that a contact face of the contacts must remain free in order to be able to function as contact.

According to another embodiment the fixed contacts are manufactured from flat material of the same thickness and the central plane of each of the contacts coincides.

This structural measure enables manufacture of the contacts from a single flat plate. Herein the plate is initially punched into the required shape, wherein recesses are arranged between the contacts and the contacts are each connected by a bridge-like portion to a carrier forming part of the plate.

According to yet another preferred embodiment each of the contacts has a boundary surface on its narrow side which is accessible from outside.

This measure has the advantage that the plate can be placed in the form-defining mould during for instance the injection moulding or other form-defining processing of the housing, the switch housing or the carrier can be manufactured and subsequently removed from the mould. The desired switch is obtained by breaking off the boundary surfaces.

It is of course also possible here to use the bridges or strips with which the switch contacts are connected to the carrier as conductors for connections to external components.

It is also possible however to break off bridges so that a separate switch is obtained.

Although the above elucidated embodiments relate to a situation where the contacts are located in one plane, the invention is not limited thereto; use can be made of contacts lying in different planes. The contacts must then of course be bent.

According to a preferred embodiment the movable contacts comprise a tilting contact adapted to make contact with a rotatable or slidable body. The tilting contacts are rotatably connected to the carrier which is provided for this purpose with a bearing or with an element which, just as the movable contacts, is preferably moulded into the carrier. This carrier preferably also forms part of the same element placed in the mould during the injection moulding.

According to yet another preferred embodiment the switch is provided with a movable part which is provided with movable contacts adapted to move over the fixed contacts. This results in an attractive embodiment of a switch.

According to yet another preferred embodiment the switch comprises four fixed contacts, the movable part is rotatable and the movable part comprises two contacts adapted to each make contact with two fixed contacts, so that the switch functions as a pole reverser switch. This also results in a structurally simple embodiment.

When the contacts of the switch are ordered at least partly circle-symmetrically, wherein the rotatable part is rotatable on the centre of symmetry of the contacts, an attractive, simple construction is obtained which is easy to embody and which can moreover be constructed in an exceptionally compact manner.

Other attractive preferred embodiments are stated in the remaining claims.

BRIEF DESCRIPTION OF THE SEVERAL VIEWS OF THE DRAWINGS

The invention will be elucidated hereinbelow with reference to the annexed drawings, in which.

DETAILED DESCRIPTON OF THE PREFERRED EMBODIMENTS

Figure 1:
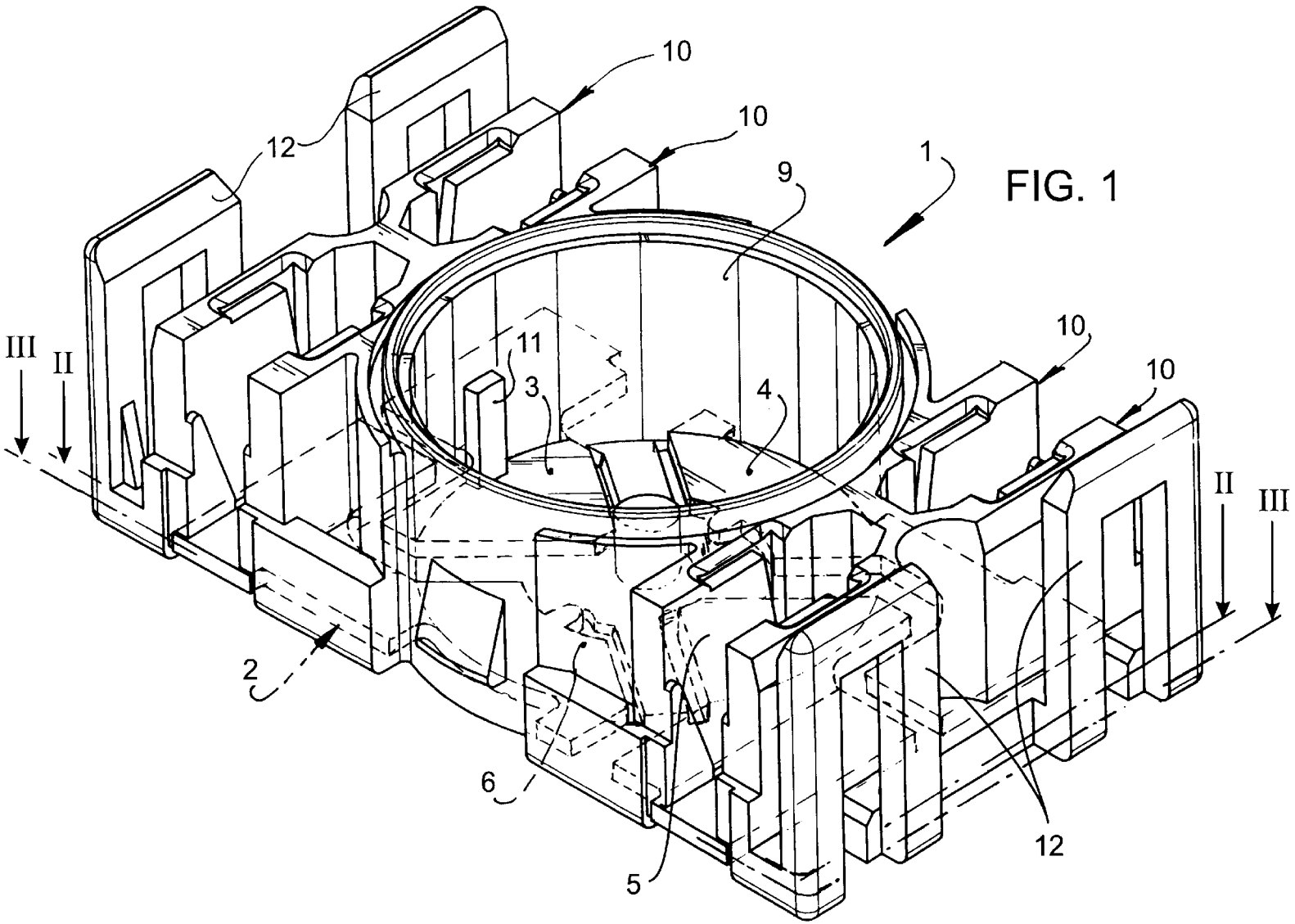
FIG. 1 shows a perspective view of a first embodiment of a switch according to the present invention.
Figure 2:
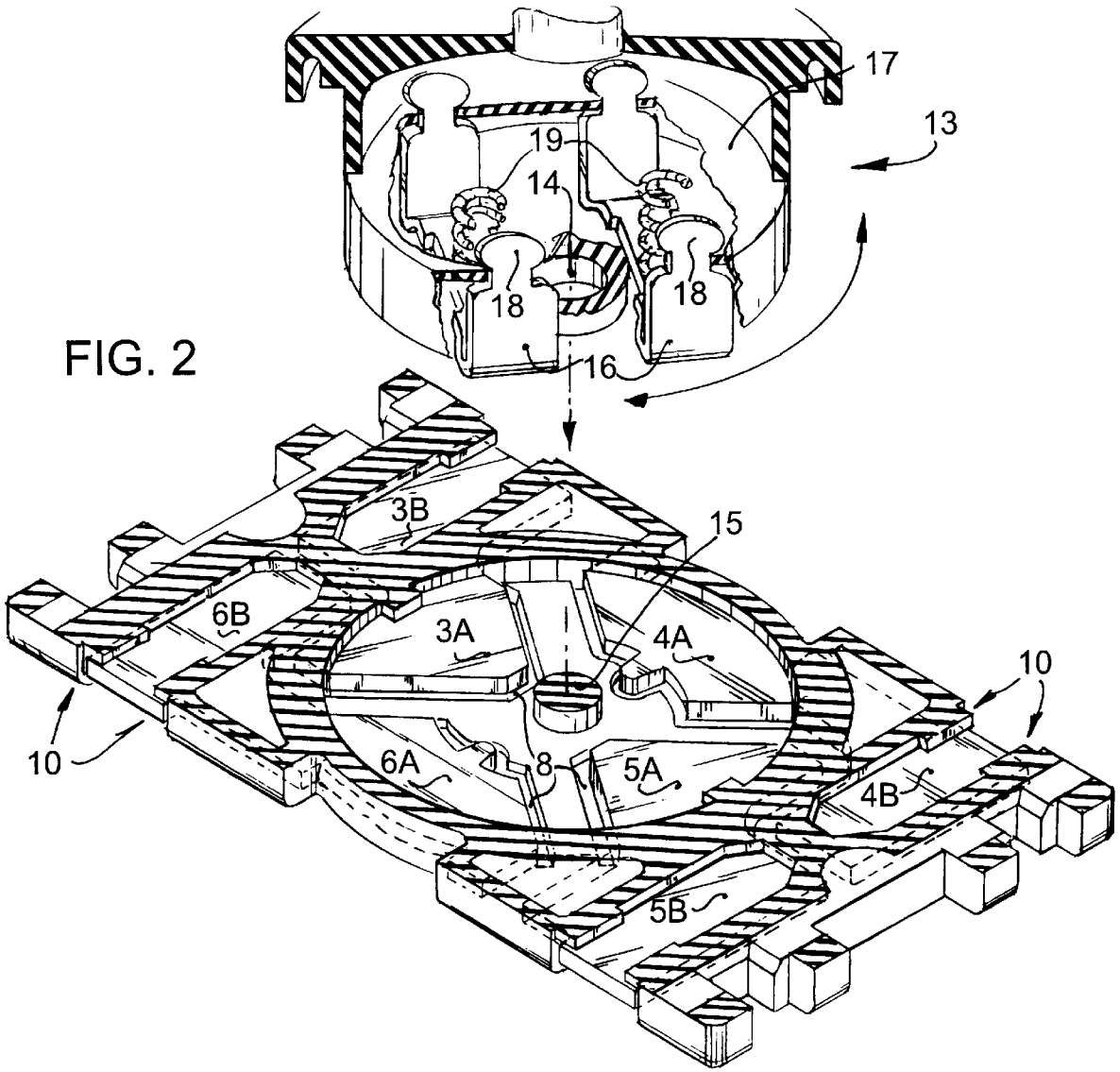
FIG. 2 is a partly broken-away view, along line II and III, of the switch shown in FIG. 1.
Figure 3:
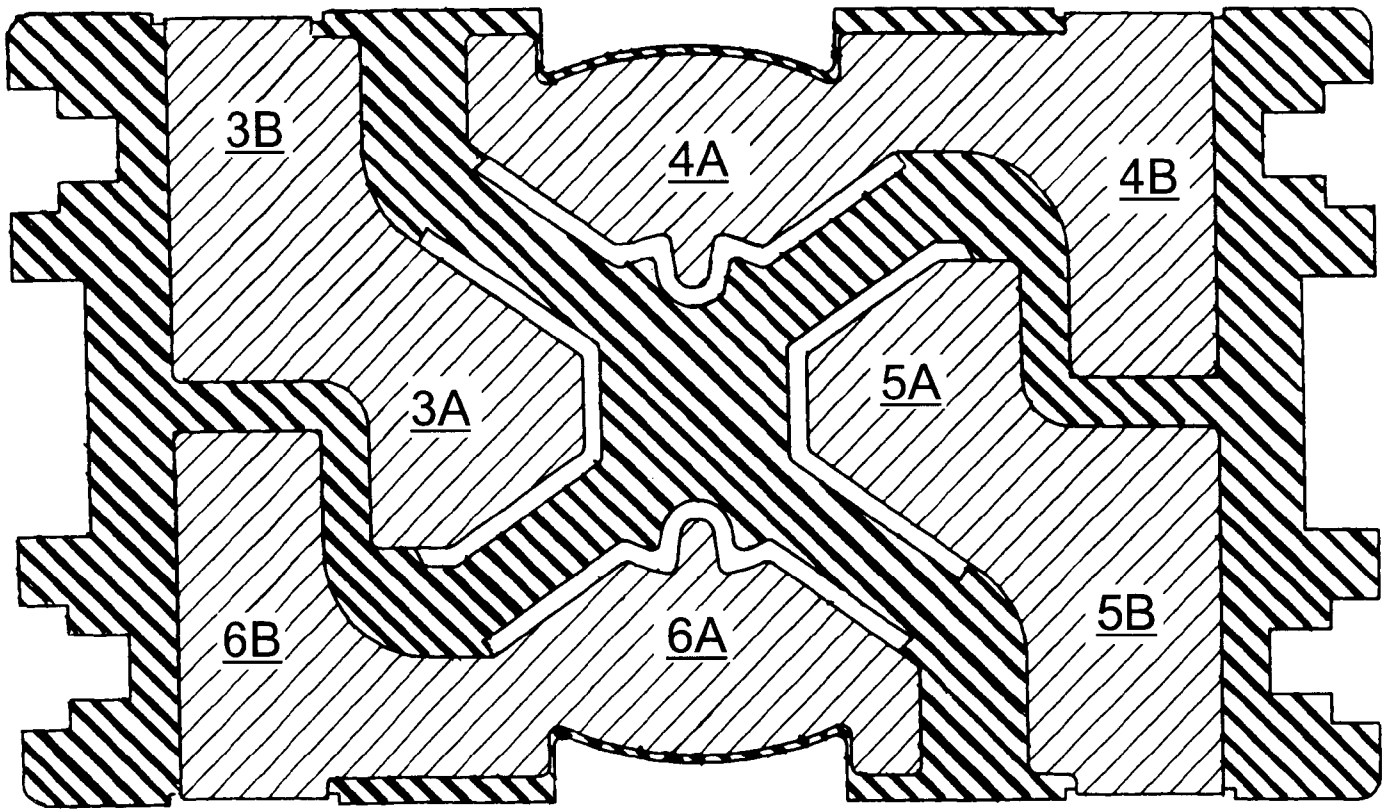
FIG. 3 is a cross-sectional view of the switch shown in FIGS. 1 and 2 along the plane defined by lines II and III.

FIG. 1 shows a switch housing 1 which is formed essentially by a plate 2 made of plastic. Diverse components are arranged on the plate, wherein however only those components will be discussed which are significant for the invention. The invention focusses essentially on the configuration of the contacts. In the present embodiment four contacts 3,4,5,6 respectively are arranged on the plate. The contacts are manufactured from sheet material, for instance of copper, silver and so on. The contacts are placed in the housing such that they are enclosed in the housing without specific fixing. All contacts are set for this purpose into the recesses arranged in plate 2. Reference is herein made to FIG. 2 in which recesses 8 are clearly shown. The contacts are closed on their top side by diverse elements of the switch housing. Among these elements are a body 9 in the shape of a cylinder casing and four parallel walls 10. Contacts 3–6 are thus enclosed between plate 2 and the associated elements 9 and 10 arranged thereabove.

The contacts are otherwise formed such that the major part of their side walls is enclosed by the plastic in which the total moulding of switch housing 1 is manufactured.

It is further pointed out that contacts 3,4,5,6 must be at least partly exposed on their side suitable for switching so that they can be touched by the movable switch contacts of the switch. In the present case that part of the contacts located inside cylinder casing 9 is left clear with the exception of two radially placed protrusions 11 which form an additional strengthening for cylinder casing 9. The remaining part of the contacts are enclosed by the diverse components of the housing. In the present embodiment there are of course other parts of the contacts which are left exposed, these being parts 3B–6B. These parts adjoin the outside of the housing so that they are accessible from outside and a contact clip can for instance be pushed onto these parts 3B–6B.

The housing is further provided with diverse components which are of less importance for the switching function but which are either necessary because of the injection moulding process or have a function in mounting of the switch body in the apparatus in which it is applied. Mounting lips 12 for instance are thus arranged with which it is possible to mount the switch, which is embodied as a pole reverser switch, on a switch adapted to control the rotation speed of an electrical hand-tool. The present switch then functions for instance as a pole reverser switch.

The switch further comprises a movable part which is designated in its entirety with 13. The movable part is substantially cylindrical and comprises in the centre a ring 14 which can rotate on a protrusion 15 arranged on the plate 10 of fixed part 1. Two elongated contacts 16 are arranged in cylindrical housing 13. Contacts 16 are arranged using fixing ears 18 in a surface 17 forming part of housing 13. Ears 18 comprise a constriction so that the contacts can move in axial direction of cylindrical housing 13. Springs 19 are arranged between the flat part of contacts 16 and surface 17. These springs 19 ensure that contacts 16 are pressed with sufficient force against contact faces 3A–6A. The present switch is a pole reverser switch, operation of which is prevented during live operation. It is thus not a drawback herein that, for instance during switching, more than two contacts 3A–4A are short-circuited by contacts 16.

It is further pointed out that wide mutual spaces are always left clear between contacts 3A–6A. These spaces have of course an insulating function but also improve the conduction of contacts 16. The material bridges 20 in question can then also be elevated to the level of the switch faces of switch contacts 3A–6A.

Figure 4:
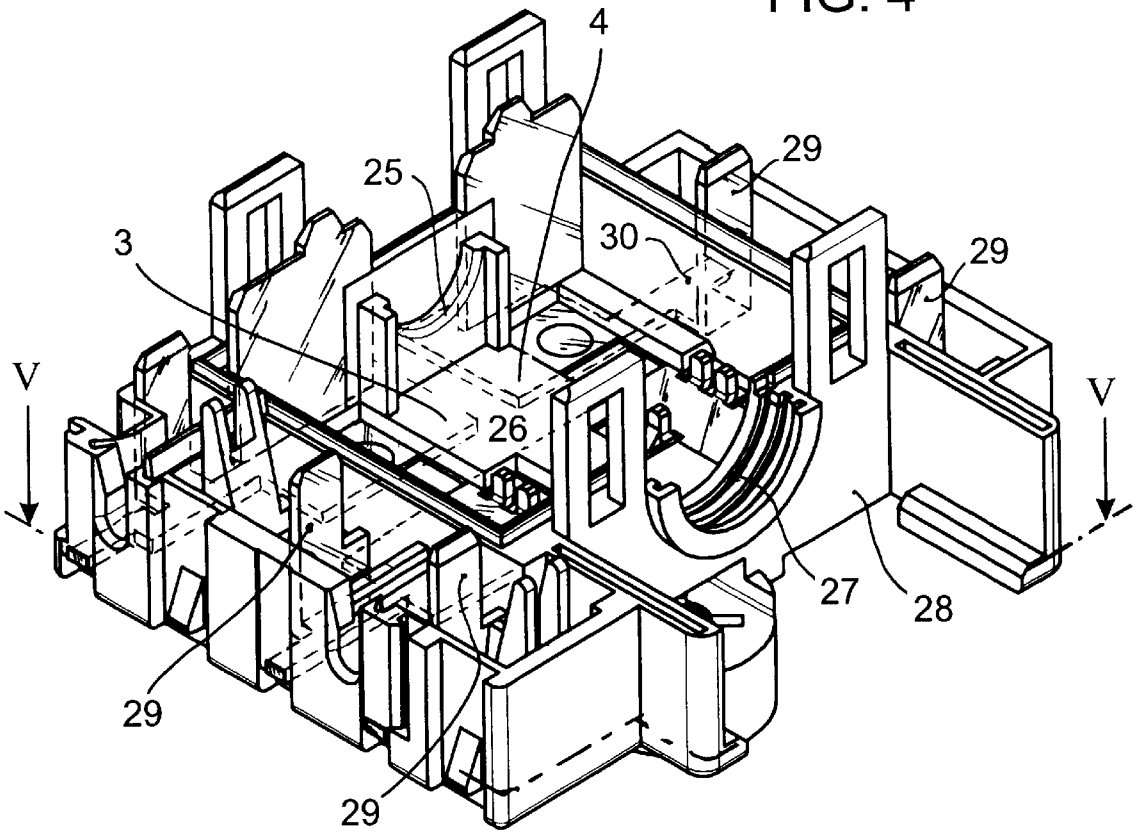
FIG. 4 shows a partly broken-away perspective view of a second embodiment of a switch according to the present invention.

Finally, FIG. 4 shows an embodiment wherein the movable contacts slide over the fixed contacts. This also has a flat plate 2 into which contacts 3,4,5 and 6 are fixedly moulded. A movable contact carrier 25 provided on its underside with a metal contact plate 26 is guidable over fixed contacts 3–6. Depending on the position of movable element 25, contact plate 26 makes contact between contacts 3 and 4 respectively 5 and 6. Use is made for driving of the contact body of a pin which protrudes through an opening 27, a part of which is formed by the recess in a side wall 28 of the housing. The shown housing is herein adapted to be snapped against another switch housing. In this embodiment the contacts are bent locally to form contact pins 29 which can be used for sliding thereon of cable shoes, but which can also be used to make contact with contact springs received in another switch. The other structural details depend on the relevant application and do not form part of the present invention.

It is finally noted that the contacts are provided with protrusions 30 with which the contacts are fixed on the carriers.

The contacts are herein initially punched from a metal plate, wherein they are connected to the carriers by means of protrusions 30. The contacts are then bent, whereafter the same procedure is finally applied as in the first embodiment.

Figure 5:
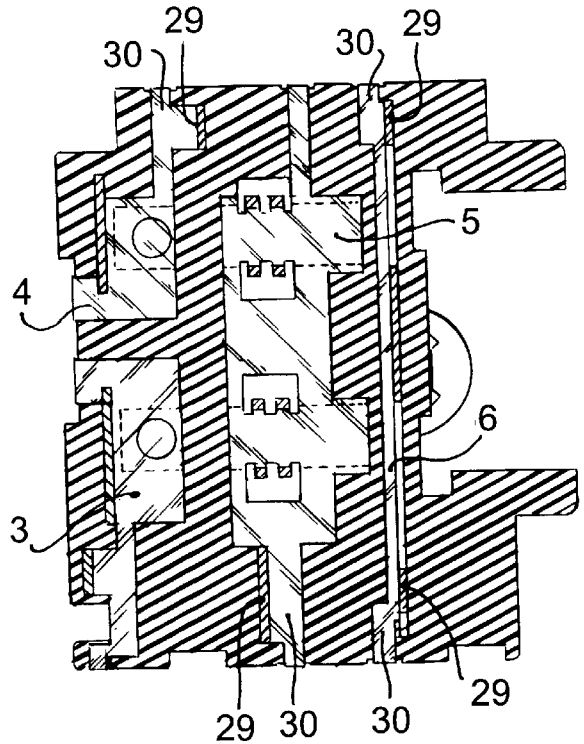
FIG. 5 is a cross-sectional view along plane V of the switch shown in FIG. 4.

FIG. 5 finally shows a cross-section of the switch depicted in FIG. 4.

What is claimed is:

1. A switch comprising a carrier which is manufactured using a plastic and in which fixed contacts are arranged, and a movable part which is mounted to the carrier, movable relative to the carrier, and in which movable contacts are arranged, characterized in that the fixed contacts each have a plurality of sides and are enclosed by, and in contact with, said carrier on at least a part of all their sides, so that the fixed contacts are fixed in the carrier, and wherein portions of said fixed contacts enclosed by said carrier are planar in shape, and wherein portions of said fixed contacts are exposed by said carrier for engagement with said movable contacts.

2. A switch as claimed in claim 1, characterized in that at least one plastic element of said carrier extends on a first side of the fixed contacts, which plastic element leaves clear a part of the surface on the first side of the fixed contacts, while fixating said fixed contacts to said carrier.

3. A switch as claimed in claim 1, characterized in that the fixed contacts are manufactured from flat material of the same thickness and central planes of the fixed contacts are coplanar.

4. A switch as claimed in claim 1, characterized in that each of the contacts has a boundary surface on a narrow side which is accessible from outside said switch.

5. A switch as claimed in claim 1, characterized in that the movable contacts are rotatably connected to the carrier.

6. A switch as claimed in claim 1, characterized in that the movable part moves the movable contacts over the fixed contacts.

7. A switch as claimed in claim 6, characterized in that the switch comprises four fixed contacts, that the movable part is rotatable, and that the movable part comprises two contacts adapted to each make contact with two of said fixed contacts, so that the switch functions as a pole reverser switch.

8. A switch as claimed in claim 7, characterized in that the four contacts of the switch are ordered at least partly circle-symmetrically, and that the rotatable part is rotatable on the centre of symmetry of the contacts.

9. A switch as claimed in claim 1, characterized in that the switch includes means for mounting said switch on a switch housing of a second switch.

10. A switch as claimed in claim 1, characterized in that the carrier is manufactured by injection moulding, wherein the fixed contacts are placed in the injection mould prior to the injection moulding.

11. A switch as claimed in claim 10, characterized in that prior to the injection moulding the fixed contacts are mounted on a common carrier which is separated from the contacts after the injection moulding.

12. A switch as claimed in claim 11, characterized in that a part of the contacts is bent prior to the moulding.

13. A switch as claimed in claim 2, characterized in that the fixed contacts are manufactured from flat material of the same thickness and central plane of the fixed contacts are coplanar.

14. A switch as claimed in claim 2, characterized in that each of the contacts has a boundary surface on a narrow side which is accessible from outside said switch.

15. A switch as claimed in claim 3, characterized in that each of the contacts has a boundary surface on a narrow side which is accessible from outside said switch.

16. A switch as claimed in claim 4, characterized in that the movable contacts are rotatably connected to the carrier.

17. A switch as claimed in claim 4, characterized in that the movable part moves the movable contacts over the fixed contacts.

18. A switch as claimed in claim 4, characterized in that the switch comprises four fixed contacts, that the movable part is rotatable, and that the movable part comprises two contacts adapted to each make contact with two of said fixed contacts, so that the switch functions as a pole reverser switch.

19. A switch as claimed in claim 5, characterized in that the switch comprises four fixed contacts, that the movable part is rotatable, and that the movable part comprises two contacts adapted to each make contact with two of said fixed contacts, so that the switch functions as a pole reverser switch.

20. A switch as claimed in claim 7, characterized in that the switch is configured to be mounted on a switch housing of a second switch.

21. The switch of claim 1, wherein said carrier further comprises a cylinder casing located above said fixed contacts.

22. The switch of claim 21, wherein said movable part is fixedly mounted in said cylinder casing, and said movable part rotates to make contact between said movable contacts and said fixed contacts.

23. The switch of claim 22, wherein said carrier is a monolithic piece of plastic formed by injection moulding, and said fixed contacts are placed in the injection mould prior to the injection moulding.

24. The switch of claim 22, wherein said switch comprises four fixed contacts in said carrier, said movable part comprises two movable contacts, and said switch is used as a pole reverser switch.

* * * * *